US009073355B2

(12) United States Patent
Mizutani

(10) Patent No.: US 9,073,355 B2
(45) Date of Patent: Jul. 7, 2015

(54) RECORDING APPARATUS WITH A BLOWING UNIT PROVIDED IN A COVER

(71) Applicant: SEIKO EPSON CORPORATION, Tokyo (JP)

(72) Inventor: Seigo Mizutani, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/022,061

(22) Filed: Sep. 9, 2013

(65) Prior Publication Data

US 2014/0009547 A1 Jan. 9, 2014

Related U.S. Application Data

(63) Continuation of application No. 12/853,563, filed on Aug. 10, 2010, now Pat. No. 8,591,023.

(30) Foreign Application Priority Data

Aug. 11, 2009 (JP) ..... 2009-186817

(51) Int. Cl.
*B41J 29/13* (2006.01)
*B41J 11/00* (2006.01)

(52) U.S. Cl.
CPC ..... *B41J 11/0015* (2013.01); *B41J 11/002* (2013.01); *B41J 11/006* (2013.01); *B41J 29/13* (2013.01)

(58) Field of Classification Search
None
See application file for complete search history.

(56) References Cited

U.S. PATENT DOCUMENTS

| | | | | |
|---|---|---|---|---|
| 4,893,137 | A * | 1/1990 | Ebinuma et al. | 346/134 |
| 2005/0122372 | A1 * | 6/2005 | Shimizu | 347/22 |
| 2007/0019051 | A1 | 1/2007 | Nakazawa | |
| 2009/0085997 | A1 | 4/2009 | Sakamoto | |

FOREIGN PATENT DOCUMENTS

| | | | |
|---|---|---|---|
| EP | 2 174 787 | | 4/2010 |
| JP | 2006-068966 | | 3/2006 |
| JP | 2006068966 | A * | 3/2006 |
| JP | 2009-034931 | | 2/2009 |
| JP | 2009073012 | A * | 4/2009 |

* cited by examiner

*Primary Examiner* — Geoffrey Mruk
*Assistant Examiner* — Bradley Thies
(74) *Attorney, Agent, or Firm* — Workman Nydegger

(57) ABSTRACT

A recording apparatus includes: a transport path for transporting a recording medium; a cover that is capable of being opened and closed and that covers the transport path when the cover is in a closed state; and a blowing unit, provided in the cover, that is capable of blowing air toward the recording medium that is on the transport path when the cover is in a closed state and that retracts from the transport path when the cover is in an open state.

4 Claims, 4 Drawing Sheets

RECORDING APPARATUS WITH A BLOWING UNIT PROVIDED IN A COVER

This application is a Continuation of application Ser. No. 12/853,563, filed Aug. 10, 2010, which is expressly incorporated herein by reference in its entirety. The entire disclosure of Japanese Patent Application No. 2009-186817 filed Aug. 11, 2009 is expressly incorporated by reference herein.

BACKGROUND

1. Technical Field

The present invention relates to recording apparatuses.

2. Related Art

Generally speaking, ink jet printers (called "printers" hereinafter) are widely known as recording apparatuses that perform recording by causing a liquid to adhere to a recording medium (for example, see JP-A-2009-34931).

The printer disclosed in JP-A-2009-34931 is provided with a drying apparatus for drying the recording medium (printing paper) onto which ink has adhered. This drying apparatus includes a suction fan for impelling air from the exterior, a heater for warming the imported air, and a nozzle portion for blowing the warmed air over the recording medium. The ink that has adhered to the recording medium is dried by using the driving of the suction fan to blow the warm air from the upstream side toward the downstream side in a transport direction.

Incidentally, the drying apparatus in JP-A-2009-34931 is provided in the transport path of the recording medium, and is disposed in a location that is very close to the recording medium in order to blow the air at a sufficient speed. The drying apparatus is thus disposed covering the transport path, and thus there has been a problem in that it is difficult to perform maintenance when paper jams or the like occur in the transport path. Note that this situation is not limited to the stated ink jet printers, and is generally common in recording apparatuses in which a drying apparatus is disposed in the transport path.

SUMMARY

An advantage of some aspects of the invention is to provide a recording apparatus in which maintenance in the transport path can be performed with ease.

A recording apparatus according to an aspect of the invention includes: a transport path for transporting a recording medium; a cover that can be opened and closed and that covers the transport path when the cover is in a closed state; and a blowing unit, provided in the cover, that is capable of blowing air toward the recording medium that is on the transport path when the cover is in a closed state and that retracts from the transport path when the cover is in an open state.

According to this configuration, the blowing unit is retracted from the transport path when the cover is in an open state, maintenance of the transport path can be carried out with ease by putting the cover into the open state.

In a recording apparatus according to another aspect of the invention, an intake opening of the blowing unit is provided on an outer surface of the cover.

According to this configuration, because the intake openings of the blowing unit are provided on the outer surface of the cover, the blowing unit can impel air from the exterior even when the cover is in a closed state, and thus air can be blown toward the recording medium in the transport path.

In a recording apparatus according to another aspect of the invention, a filter is provided in the intake opening so as to be exposed on the outside of the cover.

According to this configuration, because the filter is provided in the intake opening so as to be exposed on the outside of the cover, maintenance operations such as replacing or cleaning the filter can be performed with ease, with the cover remaining in a closed state.

In a recording apparatus according to another aspect of the invention, the cover is configured so as to be opened through a lifting operation that goes against the cover's own weight, and the recording apparatus further includes an operation assistance unit that assists the lifting operation of the cover by reducing the cover's own weight.

According to this configuration, because the cover is configured so as to open through a lifting operation that goes against the cover's own weight, and because the operation assistance unit for assisting the lifting operation by lightening the weight of the cover is furthermore provided, the opening/closing operations can be performed with ease even if the weight of the cover is increased due to the attachment of the blowing unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to the invention, embodied as a lateral-type ink jet printer, will be described based on FIGS. 1 through 4. Note that the terms "depth direction", "horizontal direction", and "vertical direction" used in the following descriptions are based on the directions indicated by arrows in FIGS. 1 through 4.

Figure 1:
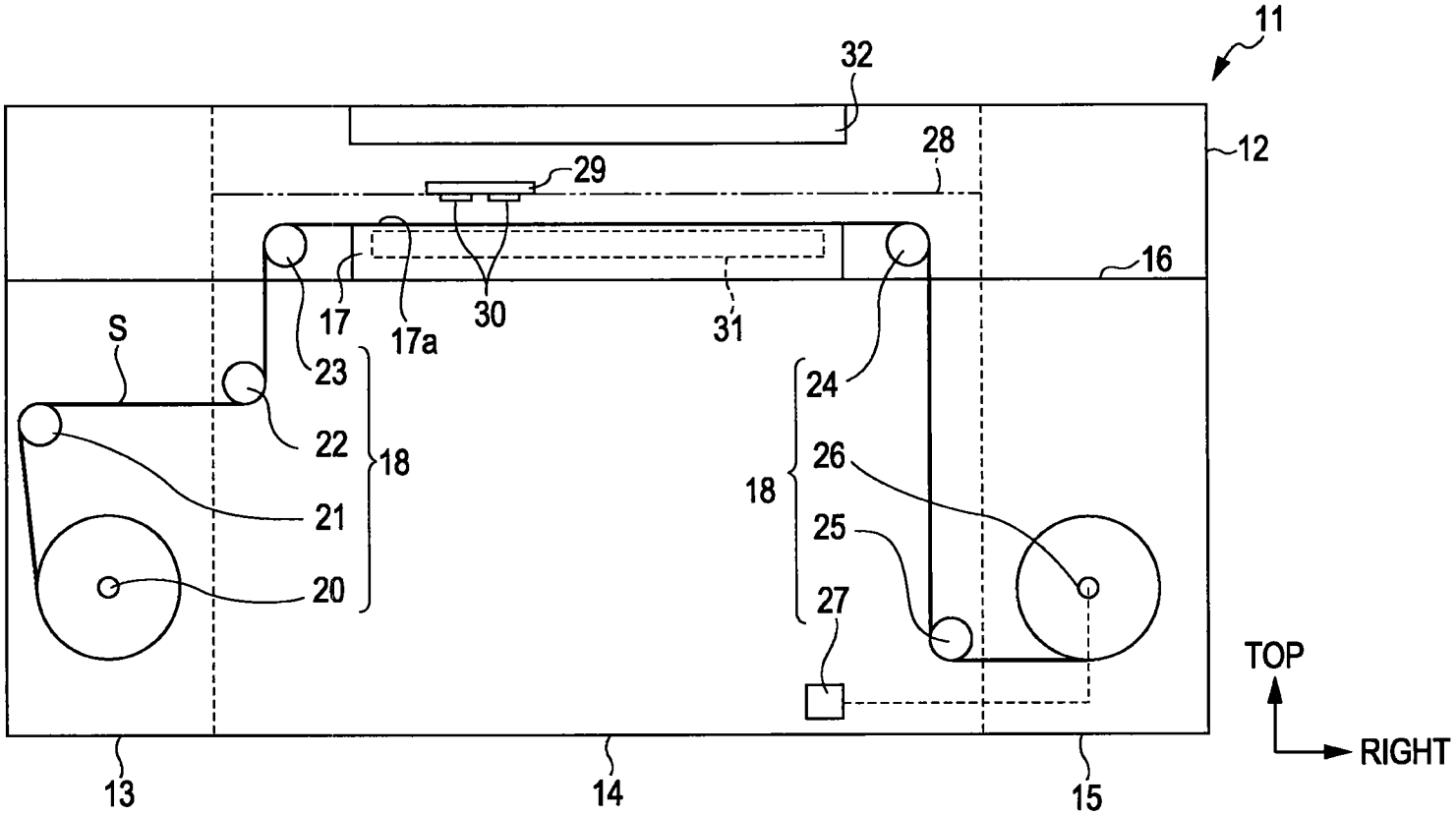
FIG. 1 is a front view illustrating the configuration of a recording apparatus according to an embodiment of the invention.

As shown in FIG. 1, a printer 11, serving as a recording apparatus, includes a rectangular-shaped main body case 12. The main body case 12 is broadly divided into three sections in the horizontal direction, which are, from the left side to the right side, a delivery section 13, a printing section 14, and a take-up section 15. In addition, a plate-shaped base 16 that divides the interior of the main body case 12 into top and bottom sections is provided within the main body case 12 in a position that is slightly higher than the central portion thereof in the vertical direction.

A rectangular plate-shaped platen 17 is disposed in the position on the base 16 that corresponds to the printing section 14. Meanwhile, a transport apparatus 18 that transports a continuous sheet S serving as a continuous sheet-shaped recording medium is contained within the main body case 12.

The transport apparatus 18 includes a winding shaft 20, rollers 21 through 25, and a take-up shaft 26 that extend in the depth direction, as well as a transport motor 27 for rotating the take-up shaft 26. The winding shaft 20 and the roller 21 are contained within the delivery section 13, the rollers 22 through 25 and the transport motor 27 are contained within the printing section 14, and the take-up shaft 26 is contained within the take-up section 15.

The continuous sheet S is stretched upon the rollers 21 through 25 in a state where the left end of the continuous sheet S is wound upon the winding shaft 20 and the right side of the continuous sheet S is wound upon the take-up shaft 26. Due to rotational driving of the transport motor 27, the continuous sheet S is transported from the delivery section 13 toward the take-up section 15 while sliding upon a support surface 17*a* that is made up of the top surface of the platen 17, which configures a transport path.

In the printing section 14, guide rails 28 (indicated by the two-dot-dash line in FIG. 1) extending in the horizontal direction are provided in front of and behind the platen 17 so as to form a pair. The top surfaces of the guide rails 28 is higher than the top surface of the platen 17, and a rectangular-shaped carriage 29 is supported by the top surfaces of the guide rails 28 so as to be capable of moving back and forth in the horizontal direction along the guide rails 28 based on the driving of a driving mechanism (not shown). A recording head 30 is supported on the bottom surface side of the carriage 29.

A set range from the left end to the right end of the platen 17 is defined as a recording region, and the continuous sheet S is transported intermittently in units corresponding to this recording region. A recording process is carried out on the continuous sheet S by ejecting ink from nozzles (not shown) provided on the bottom surface of the recording head 30, while the carriage 29 moves back and forth, onto the continuous sheet S in a state in which the continuous sheet S is stopped upon the platen 17 as a result of the intermittent transport at the recording region units.

A heater 31 for heating the support surface 17*a* is installed below the support surface 17*a* of the platen 17. The drying of the ink that has adhered to the continuous sheet S is accelerated by heat being transmitted to the continuous sheet S through the support surface 17*a* that has been heated by the heater 31. A blowing apparatus 32, which configures a blowing unit, is disposed above the platen 17 and the carriage 29.

Figure 2:
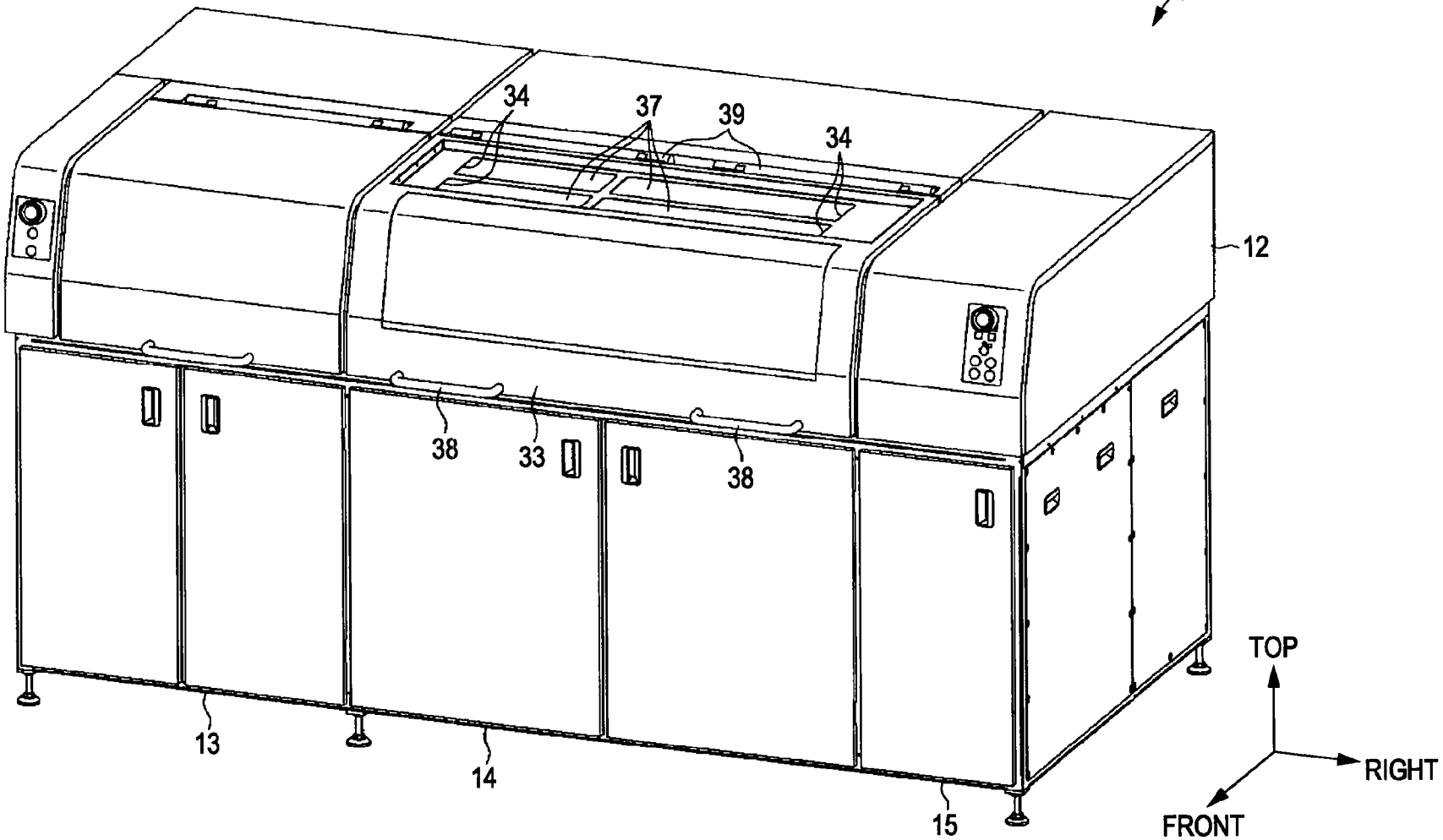
FIG. 2 is a perspective view illustrating an external view of a main body case.

Next, FIG. 2 illustrates an external view of the main body case 12 of the printer 11. A cover 33 that can be opened/closed is provided in the main body case 12, in an area on the upper side corresponding to the printing section 14. When the cover 33 is in a closed state, the cover 33 covers the platen 17 that configures the transport path for transporting the continuous sheet S.

Figure 3:
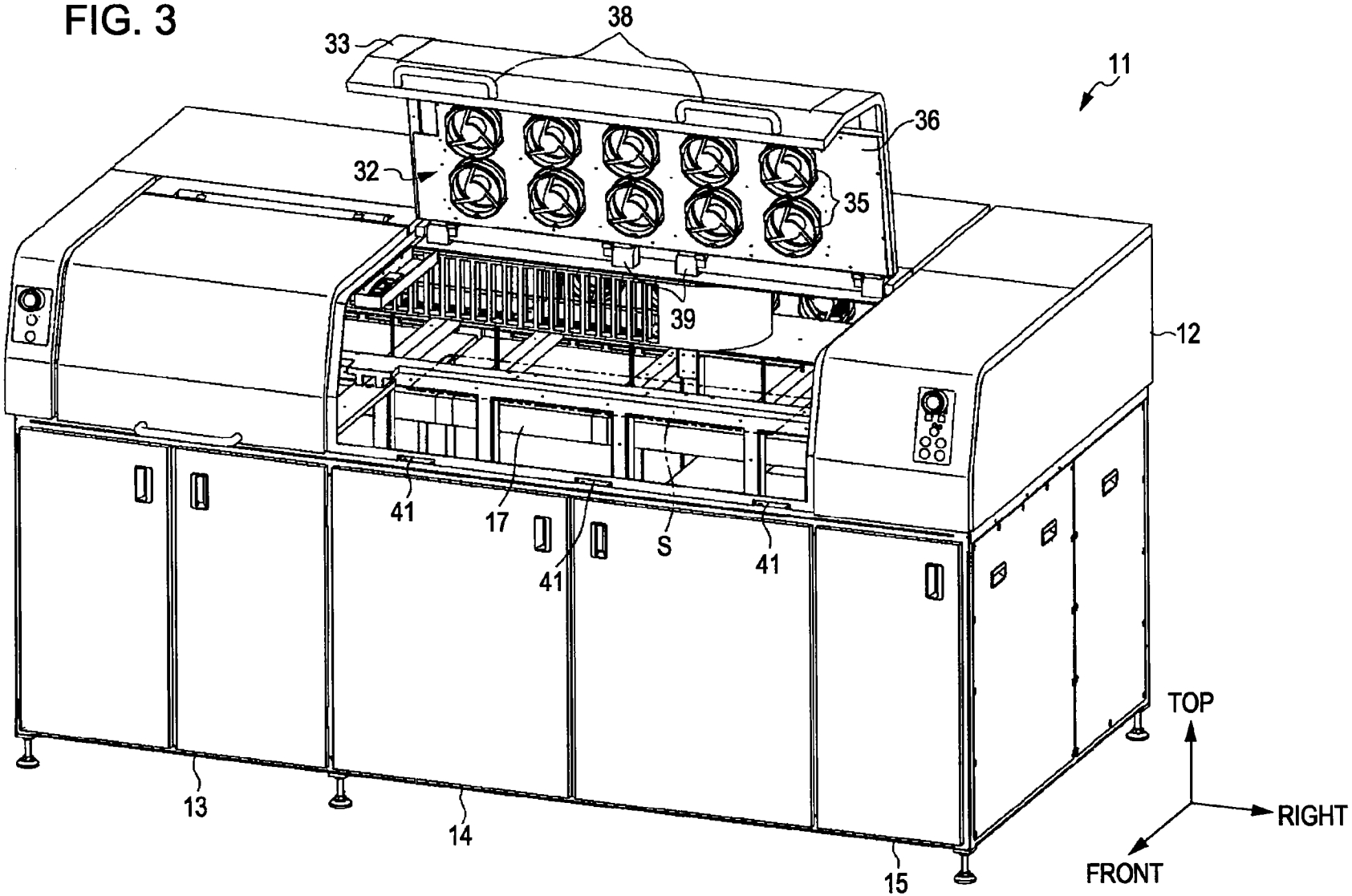
FIG. 3 is a perspective view illustrating a cover shown in FIG. 2 in an open state.

The blowing apparatus 32 is provided in the cover 33, and thus the configuration is such that the blowing apparatus 32 is capable of blowing air toward the continuous sheet S upon the platen 17 when the cover 33 is in a closed state, as shown in FIG. 2, but is retracted away from the platen 17 when the cover 33 is in an open state, as shown in FIG. 3.

Intake openings 34 (see FIG. 2) for the blowing apparatus 32 are provided in the outer surface of the cover 33, and multiple axial fans 35 (see FIG. 3) of which the blowing apparatus 32 is configured are anchored to the inside surface of the cover 33, supported by a support frame 36 (see FIG. 3). Note that the number, locations, and so on of the axial fans 35 can be adjusted as desired in accordance with the surface area, shape, and so on of the recording region.

Meanwhile, as shown in FIG. 2, filters 37, which are exposed on the outside of the cover 33, are provided in the intake openings 34 in a removable state. The filters 37 are included in the blowing apparatus 32 in order to filter the air that is blown toward the support surface 17*a* as a gaseous body. Accordingly, dirt and the like floating in the air impelled through the intake openings 34 is eliminated by the filters 37, thus suppressing the adherence of dirt and the like to the ink prior to drying. In addition, because the filters 37 are provided so as to be exposed on the outside of the cover 33, the filters 37 can be replaced with ease with the cover 33 remaining in a closed state.

As shown in FIGS. 2 and 3, the cover 33 is configured so as to be opened by a lifting operation that goes against the cover 33's own weight; handles 38 are attached to a portion corresponding to the front side when the cover 33 is closed, and hinge portions 39 are provided on the rear side of the cover 33, linking the cover 33 to the main body case 12 in a pivotable manner. Springs (not shown), serving as an operation assistance unit that assists the lifting operation of the cover 33 by biasing the cover 33 in the direction in which the cover 33 is opened and thus lightening the weight thereof, are installed in the hinge portions 39.

In addition, stopping portions 41 (see FIG. 3) are provided in portions of the main body case 12 that make contact with the front end of the cover 33 when the cover 33 is in a closed state, and stopping sections (not shown) into which the stopping portions 41 fit are provided in the front end of the cover 33. In the case where the cover 33 is in the closed state, resisting the biasing force of the springs, the stopping sections stop the stopping portions 41, thus holding the cover 33 in the closed state.

Next, the blowing apparatus 32 will be described.

Figure 4:
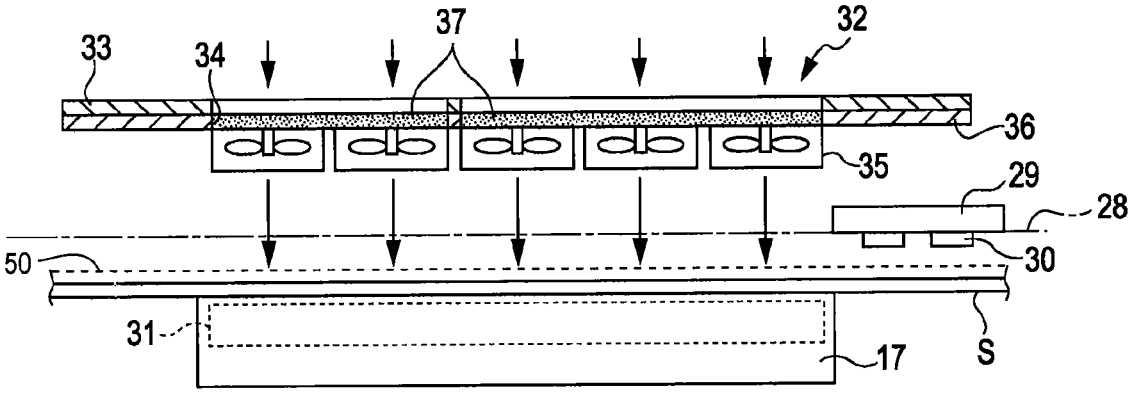
FIG. 4 is a diagram illustrating a blowing apparatus.

As shown in FIG. 4, the axial fans 35 of which the blowing apparatus 32 is configured are arranged so as to form a blowing area that opposes the support surface 17*a*, in which, when the cover 33 is in the closed state, the axial directions of the axial fans 35 follow the direction that is perpendicular to the support surface 17*a*, so that the direction of the air blown onto the support surface 17*a* is the direction that is perpendicular to the support surface 17*a*. Accordingly, the blowing apparatus 32 is capable of blowing air across the entirety of the support surface 17*a* from locations opposing the support surface 17*a* of the platen 17, so that the air force in the vicinity of the support surface 17*a* is uniform across the entirety of the support surface 17*a*.

When the recording process is executed, the cover 33 is kept in the closed state, and air is blown onto the continuous sheet S located upon the platen 17 as a result of the driving of the axial fans 35. The air velocity at this time is set so as to exceed 2 m/sec upon the continuous sheet S.

Here, when ink is ejected upon the continuous sheet S, the solvent within the ink evaporates in the vicinity of the surface (recording surface) onto which the ink has adhered, creating a state close to saturated vapor pressure. In a still air layer (diffusion layer) in which the air near the recording surface does not move, a vapor pressure gradient is formed from the saturated vapor pressure to the surrounding outer air that has not reached the saturated vapor pressure.

The air blowing performed by the blowing apparatus 32 is carried out with the purpose of increasing the vapor pressure gradient and accelerating the evaporation of the ink solvent, which is achieved by blowing air over the recording surface onto which the ink has adhered and thinning the diffusion layer. However, in the case where, for example, air is blown over the continuous sheet S from the horizontal direction, at an angle, or the like, an air velocity sufficient for thinning the diffusion layer cannot be achieved below the air, and thus there is a risk that the state of drying will not be uniform. With respect to this point, in this embodiment, the multiple axial fans 35 blow air across the entire surface of the continuous sheet S in a uniform manner at a sufficient air velocity, and it is thus possible to thin the diffusion layer at once across the entirety of the recording surface and carry out the drying process without unevenness.

Meanwhile, the recording head 30 performs the recording process by causing ink to adhere to the continuous sheet S while moving along the support surface 17*a* in the space between the support surface 17*a* and the blowing apparatus 32. For example, a single image is formed by the carriage 29 making two round-trips across the same recording region and applying ink over four scans. In such a case, by constantly blowing air while the recording process is being executed, the ink ejected with each scan is sequentially dried without unevenness, thus making it possible to suppress the occurrence of bleeding caused by inks being superposed in an insufficiently-dried state. In addition, by quickly drying the portions in which ink has been applied in each scan of the recording process, the recording process throughput can be improved as well.

Note that because the axial fans 35 are disposed above the carriage 29 and the recording head 30 is disposed below the carriage 29, the flight direction of the ink droplets is not disturbed by the air blowing. Furthermore, although the temperature within the main body case 12 does rise due to the heat from the heater 31, the recording head 30 is cooled by the outside air being blown from above the carriage 29, and thus drying of the nozzle openings can be suppressed.

Next, the effects of the printer 11 will be described.

With the printer 11, it is necessary to perform maintenance on the transport path in order to, for example, remove paper jams, clean away grime caused by ink mist, and so on. In such situations, because the blowing apparatus 32 is attached to the cover 33, the cover 33 can be lifted away from the transport path with ease through a single action simply by lifting the cover 33 open.

When the cover 33 is in an open state, the axial fans 35 are exposed in the forward direction, and thus maintenance can be performed with ease on the blowing apparatus 32 as well. On the other hand, if the cover 33 is closed, the axial fans 35 are disposed above the transport path, and thus the distance at which the axial fans 35 and the platen 17 are separated can be reduced without concern for space during maintenance, thus making it possible to achieve a sufficient air velocity on the paper surface.

According to the embodiment described thus far, the following effects can be obtained.

(1) Because the blowing apparatus 32 is retracted from the transport path when the cover 33 is in an open state, maintenance of the transport path can be carried out with ease by putting the cover 33 into the open state.

(2) Because the intake openings 34 of the blowing apparatus 32 are provided on the outer surface of the cover 33, the blowing apparatus 32 can impel air from the exterior even when the cover 33 is in a closed state, and thus air can be blown toward the continuous sheet S in the transport path.

(3) Because the filters 37 are provided in the intake openings 34 so as to be exposed on the outside of the cover 33, maintenance operations such as replacing or cleaning the filters 37 can be performed with ease, with the cover 33 remaining in a closed state.

(4) Because the cover 33 is configured so as to open through a lifting operation that goes against the cover 33's own weight, and because the hinge portions 39, in which springs serving as an operation assistance unit for assisting the lifting operation by lightening the weight of the cover 33 are installed, are furthermore provided, the opening/closing operations can be performed with ease even if the weight of the cover 33 is increased due to the attachment of the blowing apparatus 32.

The aforementioned embodiment may be changed to the embodiments described hereinafter as well.

In addition to a configuration in which the cover 33 is opened/closed through rotation, the configuration may also be such that the cover 33 is retracted from the transport path by sliding the cover 33 in the depth direction or the horizontal direction. In such a case, it is not necessary to lift the cover 33, and thus the opening/closing operations can be performed with a smaller force. Furthermore, the opening/closing operations can be carried out even in the case where there is not enough space to retract the cover 33 in the upward direction.

The hinge portions 39 may be configured without the springs, and the lifting operation may be assisted using a biasing mechanism aside from springs.

The configuration may be such that the filters 37 are not provided.

The intake openings 34 may be omitted from the cover 33, and air may instead be impelled through intake openings 34 provided in the main body case 12.

A continuous sheet-shaped plastic film, cloth, or the like may be employed as the recording medium instead of the continuous sheet S.

Although the recording apparatus is embodied as an ink jet printer in the aforementioned embodiment, a liquid ejecting apparatus that ejects or expels a liquid aside from ink may be employed as well, and the invention can be applied to various types of liquid ejecting apparatuses that include liquid ejecting heads or the like that expel miniature-sized liquid droplets. Note that "droplet" refers to the state of the liquid ejected from the liquid ejecting apparatus, and is intended to include granule forms, teardrop forms, and forms that pull tails in a string-like form therebehind. Furthermore, the liquid referred to here can be any material capable of being ejected by the liquid ejecting apparatus. For example, any matter can be used as long as the matter is in its liquid phase, including liquids having high or low viscosity, sol, gel water, other inorganic solvents, organic solvents, liquid solutions, liquid resins, and fluid states such as liquid metals (metallic melts); furthermore, in addition to liquids as a single state of a matter, liquids in which the molecules of a functional material composed of a solid matter such as pigments, metal particles, or the like are dissolved, dispersed, or mixed in a liquid carrier are included as well. Ink, described in the above embodiment as a representative example of a liquid, liquid crystals, or the like can also be given as examples. Here, ink generally includes water-based and oil-based inks, as well as various types of liquid compositions, including gel inks, hot-melt inks, and so on. The following are specific examples of liquid ejecting apparatuses: liquid ejecting apparatuses that eject liquids including materials such as electrode materials, coloring materials, and so on in a dispersed or dissolved state for use in the manufacture and so on of, for example, liquid-crystal displays, EL (electroluminescence) displays, surface emission displays, and color filters; liquid ejecting apparatuses that eject bioorganic matters used in the manufacture of biochips; liquid ejecting apparatuses that eject liquids to be used as samples for precision pipettes; dying apparatuses and microdispensers; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatus that eject an etching liquid such as an acid or alkali onto a substrate or the like for etching. The invention can be applied to any type of these ejecting apparatuses.

Additional descriptions of the technical spirit that can be understood from the aforementioned embodiment and variations will be given hereinafter.

The recording apparatus according to an aspect of the invention, the blowing unit includes multiple axial fans, and the axial fans are arranged so as to form a blowing area that opposes a support surface, in a state in which the axial directions of the axial fans follow the direction that is perpendicular to the support surface.

According to this configuration, the blowing unit includes multiple axial fans arranged so as to form the blowing area that, when the cover is in a closed state, opposes the support surface in a state in which the axial directions of the axial fans follow the direction that is perpendicular to the support surface. Accordingly, the multiple axial fans can be retracted from the transport path at once by putting the cover into an open state.

What is claimed is:

1. A recording apparatus comprising:

a delivery section having a winding shaft winding a recording medium;

a printing section having a recording head moving back and forth along a transporting direction of the recording medium, the recording medium supported by a support surface; and a take-up section having a take-up shaft winding up the recording medium after printing, and wherein the delivery section, the printing section and the take-up section are horizontally located in a line in order, and further comprising:

a cover, provided in the printing section, that is capable of being opened and closed; and a blowing unit, mounted to the cover, that is capable of blowing air only towards the entirety of the support surface on which the recording medium is supported when the cover is in the closed state and while the recording head moves back and forth, the blowing unit being movable with the cover and vertically above the recording medium when the cover is in both an open state and a closed state, in the open state the blowing unit being orientated transversely to an orientation of the blowing unit in the closed state, the blowing unit configured to blow the air such that an air force is substantially uniform in a vicinity of the support surface, wherein the blowing unit is arranged such that a flight direction of ink droplets ejected by the printing section are unaffected by the blown air.

2. The recording apparatus according to claim 1, wherein an intake opening of the blowing unit is provided on an outer surface of the cover.

3. The recording apparatus according to claim 2, wherein a filter is provided in the intake opening so as to be exposed on the outside of the cover.

4. The recording apparatus according to claim 1, wherein the cover is configured so as to be opened through a lifting operation that goes against the cover's own weight, and the recording apparatus further comprising:

an operation assistance unit that assists the lifting operation of the cover.

* * * * *